United States Patent [19]

Sobel et al.

[11] 4,330,606

[45] May 18, 1982

[54] COLOR PHOTOGRAPHIC MATERIALS AND COLOR PHOTOGRAPHIC IMAGES

[75] Inventors: Johannes Sobel, Leverkusen; Karl-Wilhelm Schranz, Odenthal, both of Fed. Rep. of Germany

[73] Assignee: AGFA-Gevaert AG, Leverkusen, Fed. Rep. of Germany

[21] Appl. No.: 184,035

[22] Filed: Sep. 4, 1980

[30] Foreign Application Priority Data

Sep. 8, 1979 [DE] Fed. Rep. of Germany ..... 2936429

[51] Int. Cl.[3] ..... G03C 1/40; G03C 7/00

[52] U.S. Cl. ..... 430/17; 430/372; 430/551

[58] Field of Search ..... 430/17, 372, 551, 546, 430/543, 463

[56] References Cited

U.S. PATENT DOCUMENTS

| | | | |
|---|---|---|---|
| 2,579,435 | 12/1951 | Mackey | 430/372 |
| 2,579,436 | 12/1951 | Mackey | 430/372 |
| 3,471,295 | 10/1969 | Bockly et al. | 430/551 |
| 3,689,271 | 9/1972 | Nittel et al. | 430/543 |
| 3,887,376 | 6/1975 | Wilson et al. | 96/66 R |
| 3,893,863 | 7/1975 | Wilson et al. | 96/95 |
| 4,087,283 | 5/1978 | Battisti | 430/543 |
| 4,146,399 | 5/1979 | Trunley et al. | 430/546 |

*Primary Examiner*—J. Travis Brown

*Attorney, Agent, or Firm*—Connolly and Hutz

[57] ABSTRACT

Compounds of the formulae

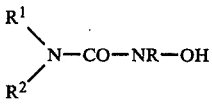

I

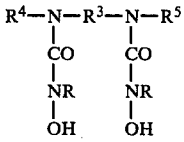

II

III are useful as antifading agents in photographic materials.

4 Claims, No Drawings

COLOR PHOTOGRAPHIC MATERIALS AND COLOR PHOTOGRAPHIC IMAGES

This invention relates to a light-sensitive colour photographic recording material containing colour couplers and at least one compound to be used according to the invention as agent for preventing bleaching of the dye images produced by chromogenic development of the colour couplers. The invention also relates to colour photographic images containing at least one compound to be used according to the invention.

Phenolic couplers, i.e. phenols and naphthols are normally used for producing cyan dye images; pyrazolone, indazolone or cyanacetyl couplers for producing magenta dye images and open chain ketomethylene compounds such as acyl acetamide or dibenzoyl methane couplers for producing yellow dye images.

In the known colour photographic processes, the couplers which produce the dyes are used either in a developer solution or introduced into the light-sensitive photographic emulsion layers or other dye-forming layers so that they are able to react with the oxidation products of the dye developer compounds during development to produce the dyes.

As is known, the dye images produced by the method described above do not have unlimited stability under UV-radiation or visible light and therefore bleach gradually under prolonged exposure to light.

To overcome this disadvantage it has been attempted, for example, to incorporate UV absorbents in the colour photographic material in order to reduce the damaging effect of UV-radiation. The use of UV absorbents, however, in no way prevents fading of the colour image due to the action of visible light so that the use of UV absorbents provides only a limited and not wholly satisfactory improvement in the stability of dyes to the action of light.

It is also known to increase the resistance to light of the visible spectrum; see, for example, British Pat. Nos. 909,824; 909,825 and 909,826 and U.S. Pat. Nos. 3,095,302; 3,801,322 and 3,775,124.

One particular disadvantage of the known measures for improving the stability to light is that the antifading effect diminishes after prolonged storage of the colour photographic material and may be lost completely after a certain time. Moreover, so called "after yellowing" occurs in some cases due to the action of actinic radiation on areas of the processed colour photographic material which contain unreacted coupler, i.e. unexposed areas of the material. Some of these compounds are only sparingly soluble in the solvent when added to a colour photographic material, and some of them, due to their diffusibility, diffuse into processing solutions which are at a high pH. Although some of these compounds show an anti-fading effect in colour images produced from yellow couplers and cyan couplers, they have no such effect on colour images produced from magenta couplers. Other compounds, again, have no effect on the dye images produced from yellow and cyan couplers and in some cases even accelerate their fading and yet have a relatively effective anti-fading action on colour images produced from magenta couplers.

It is an object of the present invention to provide a colour photographic recording material containing an anti-fading agent which has an excellent anti-fading action, excellent solubility in high boiling solvents, etc, excellent dispersibility and excellent diffusion resistance and does not deleteriously affect other photographic additives nor inhibit colour formation of the couplers.

A light-sensitive photographic material comprising a support layer and at least one hydrophilic binder layer containing a colour coupler for producing a dye image has now been found which contains at least one compound corresponding to formula I, II or III:

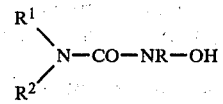

I

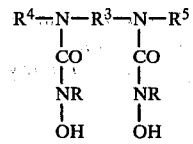

II

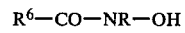

III in which

R represents hydrogen or an alkyl group, in particular with a maximum of 3 carbon atoms, especially a methyl or ethyl group;

$R^1$ represents hydrogen or an alkyl group, in particular with not more than 12 carbon atoms, especially a methyl, ethyl, propyl, butyl, pentyl, octyl or dodecyl group; a cycloalkyl group, in particular with 5 or 6 carbon atoms, especially a cyclopentyl or cyclohexyl group; an aralkyl group in particular with not more than 2 carbon atoms in the aliphatic moiety and 6 to 12 carbon atoms in the aromatic moiety, especially a benzyl group; an aryl group, in particular with 6 to 12 carbon atoms, especially a phenyl or naphthyl group;

$R^2$ represents an alkyl group, in particular with not more than 18 carbon atoms, especially a methyl, ethyl, propyl, butyl, pentyl, octyl, dodecyl or octadecyl group; a cycloalkyl group in particular with 5 or 6 carbon atoms, especially a cyclopentyl or cyclohexyl group; an aralkyl group, in particular with not more than 2 carbon atoms in the aliphatic moiety and 6 to 12 carbon atoms in the aromatic moiety, especially a benzyl group; an aryl group, in particular with 6 to 12 carbon atoms, especially a phenyl or naphthyl group;

$R^3$ represents a divalent hydrocarbon group in particular an alkylene group, preferably with not more than 6 carbon atoms, or an arylene group, in particular a phenylene group;

$R^4$ and $R^5$, which may be the same or different, represent hydrogen or an alkyl group, in particular with not more than 12 carbon atoms, especially a methyl, ethyl, propyl, butyl, pentyl or octyl group;

$R^6$ represents an alkyl group, in particular with not more than 17 carbon atoms, especially with 7 to 11 carbon atoms; a cycloalkyl group, in particular with 5 or 6 carbon atoms, especially a cyclopentyl or cyclohexyl group; an aralkyl group, in particular with not more than 4 carbon atoms in the aliphatic moiety and 6 to 12 carbon atoms in the aromatic moiety, especially a benzyl group; or an aryl group, in particular with 6 to 12 carbon atoms, especially a phenyl or naphthyl group; and/or $R^1$ and $R^2$ together represent the atoms required to complete a heterocyclic ring and/or $R^3$ together with $R^4$ and optionally also $R^5$ represents the atoms required to complete a heterocyclic ring.

The compounds to be used according to the invention are incorporated in diffusion resistant form in the light-sensitive photographic materials and are generally insoluble in water and alkalies.

The groups R and $R^1$ to $R^6$ may also be substituted with the usual substituents for photographic materials. Examples of such substituents include halogens such as chlorine or a sulpho, methyl, ethyl, tertiary butyl, pentyl, benzyl, propylphenyl, methoxy, ethoxy and phenoxy group.

If the groups $R^1$ and $R^2$ do not represent the atoms required for completing a heterocycling ring $R^1$ and $R^2$ together have at least 10 carbon atoms. When $R^1$ and $R^2$ together form a heterocyclic ring, it has at least 7 carbon atoms, taking into account any substituents.

According to a preferred embodiment, the substituents R to $R^6$ have the following meaning:

R represents hydrogen or a methyl or ethyl group;

$R^1$ represents hydrogen or a methyl, ethyl, propyl, butyl, pentyl, octyl, cyclohexyl, phenyl or benzyl group;

$R^2$ represents a pentyl, octyl, dodecyl, octadecyl, cyclohexyl or naphthyl group;

$R^3$ represents a methylene, hexylene or phenylene group;

$R^4$ represents hydrogen or a propyl, butyl, pentyl or octyl group;

$R^5$ represents hydrogen or a propyl, butyl, pentyl or octyl group;

$R^6$ represents a heptyl, undecyl, heptadecyl cyclohexyl or phenoxy group.

The compounds shown in Table 1, 2 and 3 have proved to be particularly suitable.

TABLE 1

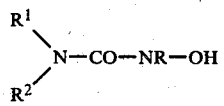

(I)

| No. | R | $R^1$ | $R^2$ | $R^1$ / N / $R^2$ |
|---|---|---|---|---|
| 1.1 | $CH_3$ | H | n-$C_{12}H_{25}$ | — |
| 1.2 | H | H | n-$C_{18}H_{37}$ | — |
| 1.3 | H | $CH_3$ | n-$C_{12}H_{25}$ | — |
| 1.4 | H | $CH_3$ | n-$C_{18}H_{37}$ | — |
| 1.5 | H | $C_2H_5$ | n-$C_{14}H_{29}$ | — |
| 1.6 | H | $C_3H_7$ | tert. $C_8H_{17}$ | — |
| 1.7 | H | n-$C_4H_9$ | n-$C_7H_{15}$ | — |
| 1.8 | H | i-$C_5H_{11}$ | i-$C_5H_{11}$ | — |
| 1.9 | H | i-$C_8H_{17}$ | i-$C_8H_{17}$ | — |
| 1.10 | H | cyclohexyl | cyclohexyl | — |
| 1.11 | H | H | 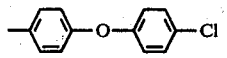 | — |
| 1.12 | H | benzyl | benzyl | — |
| 1.13 | H | $C_2H_5$ | α-naphthyl | — |
| 1.14 | H | β-naphthyl | $C_2H_5$ | — |
| 1.15 | H | i-$C_3H_7$ | $C_2H_5$ | — |
| 1.16 | H | n-$C_4H_9$ | phenyl | — |
| 1.17 | H | i-$C_4H_9$ | phenyl | — |
| 1.18 | H | n-$C_4H_9$ | 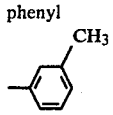 | — |
| 1.19 | H | n-$C_8H_{17}$ | phenyl | — |
| 1.20 | H | n-$C_8H_{17}$ | 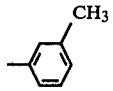 | — |
| 1.21 | H | phenyl | benzyl | — |
| 1.22 | H | phenyl | phenyl | — |
| 1.23 | H | phenyl | 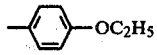 | — |
| 1.24 | H | phenyl | β-naphthyl | — |
| 1.25 | H | phenyl | α-naphthyl | — |
| 1.26 | H | 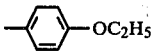 | α-Naphthyl | — |
| 1.27 | H | — | — | 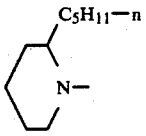 |

TABLE 1-continued

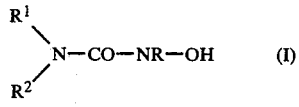

(I)

| No. | R | $R^1$ | $R^2$ | $R^1$ N $R^2$ |
|---|---|---|---|---|
| 1.28 | H | — | — | 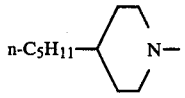 |
| 1.29 | H | — | — | 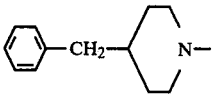 |
| 1.30 | H | — | — | 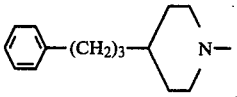 |

TABLE 2

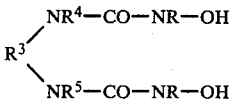

(II)

| No. | R | $R^3$ | $R^4$ | $R^5$ |
|---|---|---|---|---|
| 2.1 | H | $CH_2$ | i-$C_8H_{17}$ | i-$C_8H_{17}$ |
| 2.2 | H | $(CH_2)_6$ | i-$C_4H_9$ | i-$C_4H_9$ |
| 2.3 | H | $(CH_2)_6$ | i-$C_5H_{11}$ | i-$C_5H_{11}$ |
| 2.4 | H | phenyl | i-$C_8H_{17}$ | i-$C_8H_{17}$ |
| 2.5 | H | 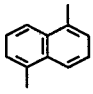 | H | H |
| 2.6 | $CH_3$ | 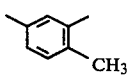 | H | H |
| 2.7 | $C_2H_5$ | 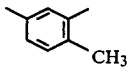 | H | H |

TABLE 3

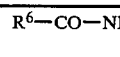

(III)

| No. | R | $R^6$ |
|---|---|---|
| 3.1 | H | n-$C_{11}H_{23}$ |
| 3.2 | H | n-$C_{17}H_{35}$ |
| 3.3 | H | cyclohexyl |
| 3.4 | H | 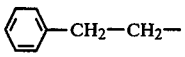 |
| 3.5 | H | tert.-$C_4H_9$— 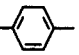 |
| 3.6 | H | phenoxy |
| 3.7 | H | naphthoxy |
| 3.8 | $CH_3$ | n-$C_{11}H_{23}$ |
| 3.9 | H | i-$C_7H_{15}$ |

Colour photographic images containing at least one of the compounds, 1, 11 and 111 have also been found.

These images may be obtained by exposure and development of the light sensitive colour photographic material according to the invention.

The compounds to be used according to the invention may be prepared by methods known in the literature. Compounds of formulae 1 and 11, for example, may be prepared according to German Auslegeschriften Nos. 1,127,344; 1,129,151; 1,131,655 and 1,135,890 and German Offenlegungsschrift No. 2,415,603, and compounds of formula 111 by for example, the methods given in Houben-Weyl, Methoden der Organischen Chemie, Volume 8, pages 684 et seq or in "Organic Functional Group Preparations", Academic Press, New York, Chapter 12, pages 406 et seq.

The use of certain hydroxy ureas has been disclosed in U.S. Pat. Nos. 3,893,863 and 3,887,376, but these are used as developer substances (a) in baths, and (b) in photographic materials, especially in heat-sensitive materials.

Compounds of formulae 1 to 111 are efficient stabilizers for improving the stability to light of indophenol, indoaniline and azomethine dyes which have been produced by chromogenic development.

The compounds to be used according to the invention for preventing bleaching may be used in combination with a UV absorbent for an even greater improvement in the light-fastness of the colour image. Examples of suitable UV absorbents include compounds of the benzophenone, acrylonitrile, thiazolidone, benzotriazol, stilbene, oxazole, thiazole and imidazole series.

The compounds to be used according to the invention are, in general, colourless and therefore do not impair the image whites and have no deleterious effect on colour development or on other photographic additives.

Two or more of the compounds according to the invention may be used in a material. They may also be used together with other known stabilizers or anti-blotching agents, for example with hydroquinones containing ballasting groups or with phenolic antioxidants.

The concentration of the compounds used according to the invention in the photographic layers may vary considerably and depends mainly on the amount of improvement in stability required. It has been found suitable to use the compounds in quantities of 0.2 to about 2 parts by weight per 1 part by weight of colour coupler and it is preferred to use about 0.5 to 1 part by weight of stabilizer to 1 part by weight of coupler.

The completely developed photographic image advantageously contains the compounds used according to the invention at a concentration above 100 mg/m$^2$. A quantity of 100 to 2000 mg/m$^2$, in particular 300 to 800 mg/m$^2$ is preferred.

The emulsifiable compounds to be used according to the invention may in principle be used in any hydrophilic colloidal layers of binders and are preferably used in those which also contain colour couplers for producing the colour image. These layers may be silver halide emulsion layers or adjacent light insensitive layers of binders. The compounds used according to the invention may be emulsified in known manner, e.g. by directly mixing a solution of these compounds in a low boiling solvent with the silver halide emulsion or the casting solution for the layer containing the couplers or first mixing it with an aqueous gelatine solution and then evaporating off the organic solvent. The compounds are advantageously used together with the colour coupler.

An emulsion of such a compound in gelatine obtained in this manner is subsequently mixed with the silver halide emulsion or with the casting solution which contains colour coupler. A so-called coupler solvent or oil former may be used in addition to emulsify the compounds according to the invention. These coupler solvents or oil formers are generally relatively high boiling organic compounds in which the nondiffusible colour coupler which is required to be emulsified in the silver halide emulsions is enclosed in the form of oily droplets. Reference may be made in this connection to, for example, U.S. Pat. Nos. 2,322,027; 3,689,271; 3,764,336 and 3,765,897.

The following oil formers are particularly preferred:

(a) Compounds of formula IV

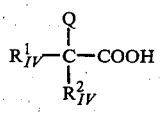

IV in which $R_{IV}^1$ represents a saturated or olefinically unsaturated aliphatic hydrocarbon group having 1 to 18 carbon atoms which may be substituted;

$R_{IV}^2$ represents hydrogen or a saturated or olefinically unsaturated aliphatic hydrocarbon group having 1 to 18 carbon atoms which may be substituted; and Q represents COX or $CH_2COX$ in which X may represent (1) hydrogen, hydroxy, alkoxy;

(2) the group O-alkylene-[O-alkylene]$_n$-O-alkyl, where n=0 to 10;

(3) a substituted or unsubstituted amino group;

(4) a hydrazine group or (5) a hydroxylamine group.

These oil formers have been described, for example in U.S. Pat. No. 3,689,271.

In a preferred embodiment, $R_{IV}^1$ represents a butyl dodecylene, pentadecylene, octadecylene, iso-dodecylene, or iso-pentadecylene $R_{IV}^2$ represents hydrogen or ethyl; and Q represents $CH_2$—COOH; $CH_2COOC_4H_9$; $CH_2COOC_8H_{17}$; $CH_2$—$COOC_9H_{19}$; $CH_2$—$COOC_{12}H_{25}$ or $CH_2$—CO—N($CH_2$—CHOH—$CH_3$)$_2$ (b) Compounds corresponding to the formulae

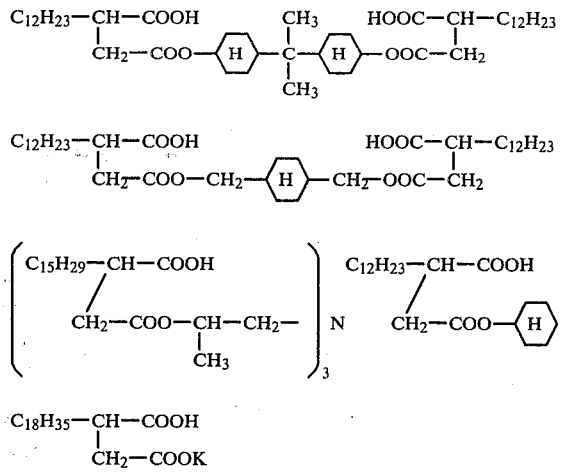

(c) The following compounds have also proved to be particularly suitable:

di-N-butylphthalate; benzylphthalate; triphenyl phosphate; tri-o-cresyl phosphate; diphenyl mono-p-tertiary butyl-phenyl-phosphate; monophenyl-di-p-tertiary butyl-phenyl phosphate; diphenyl-mono-o-chlorophenyl phosphate; 2,4-di-n-pentyl-phenol; 2,4-di-tertiary pentyl phenol; N,N-diethyl lauramide.

If the stabilizers to be used according to the invention are used in a layer containing colour couplers, it is advantageous to prepare an emulsion of both the colour coupler and the stabilizer and then add this common emulsion to the casting solution for the required layer. Such an emulsion need not necessarily contain an addition oil former. In fact, some of the stabilizers to be used according to the invention are suitable as oil formers and therefore combine the functions of a dye-stabilizer with that of an oil former. It is obvious that such a combined function reduces the quantity of compound to be added to the layer, and this has an advantageous effect on the required thickness of the layer.

The photographic materials to which the present invention is applied may contain any silver halide emulsions, including emulsions of silver bromide, silver chloride or mixtures thereof, which may have a silver iodide content of up to 10 mol %.

The photographic materials may be developed with the usual colour developer substances, e.g. N,N-dimethyl-p-phenylene diamine; 4-amino-3-methyl-N-ethyl-N-methoxyethyl aniline; 2-amino-5-diethylamino toluene; N-butyl-N-ωsulpho butyl-p-phenylene diamine; 2-amino-5-(N-ethyl-N-β-methane sulphonamido ethylamino)-toluene; N-ethyl-N-β-hydroxyethyl-p-phenylene diamine; N,N-bis-(β-hydroxyethyl)-p-phenylene diamine or 2-amino-5-(N-ethyl-N-β-hydroxyethylamino)-toluene. Other suitable colour developers have been described, for example, in J. American Chem. Soc. 73, 3100 (1951).

The photographic material may contain the usual colour couplers which may be directly incorporated in the silver halide layers. Examples of suitable colour couplers may be found in the publication entitled "Farbkuppler" by W. Pelz in "Mitteilungen aus den Forschungslaboratorien der Agfa, Leverkusen/Munchen", Volume 111 (1961) and K. Venkataraman in "The Chemistry of Synthetic Dyes", Volume 4, 341 to 387 Academic Press, 1971. 2-equivalent couplers may also be used as non-diffusible colour couplers, for example, the known DIR couplers. The non-diffusible colour couplers and the colour producing compounds may be added to the lightsensitive silver halide emulsion or to other casting solutions by the usual, known methods.

If the non-diffusible colour couplers and colour producing compounds are insoluble in water or alkalies, they may be emulsified in known manner. So-called coupler solvents or oil formers may, if indicated, be added for emulsifying such hydrophobic compounds; see, for example, U.S. Pat. Nos. 2,322,027; 2,533,514; 3,689,271; 3,764,336 and 3,765,897.

If the material according to the invention is an image transfer material, the compounds used according to the invention are generally added to the image receiving layer.

The binder used for the photographic layers is preferably gelatine although this may be partially or completely replaced by other natural or synthetic binders..

The emulsions may also be chemically sensitized, for example by the addition of sulphur compounds such as allyl isothiocyanate, allylthio urea or sodium thiosulphate at the chemical ripening stage. Reducing agents may also be used as chemical sensitizers, for example the tin compounds described in Belgium Pat. Nos. 493,464 and 568,687 or polyamines such as diethylene triamine or aminomethyl sulphinic acid derivatives, e.g. according to Belgian Pat. No. 547,323. Noble metals such as sold, platinum, palladium, iridium, ruthenium or rhodium and compounds of these metals may also be used as chemical sensitizers. The emulsions may also be sensitized with polyalkylene oxide derivatives, e.g. with a polyethylene oxide having a molecular weight in the range of 1,000 to 20,000, or with condensation products of alkylene oxides and alcohols, aliphatic carboxylic acids, aliphatic amines, aliphatic diamines and amides.

The emulsions may also be optically sensitized, e.g. with the usual polymethine dyes such as neutrocyanines, basic or acid carbocyanines, rhodacyanines, hemicyanines, styryl dyes and oxonoles. Stabilizers of this type have also been described in the work by F. M. Hammer, "The Cyanine Dyes and related Compounds", (1964).

The emulsions may contain the usual stabilizers, e.g. homopolar or salt type compounds of mercury containing aromatic or heterocyclic rings, such as mercapto triazoles, simple mercury salts, sulphonium mercury double salts and other mercury compounds. Azaindenes are also suitable stabilizers, particularly tetra and penta azaindenes, especially those which are substituted with hydroxyl or amino groups. Compounds of this type have been described, e.g. in the article by Birr, Z. Wiss. Phot. 47 (1952), 2 to 58. Other suitable stabilizers include heterocyclic mercapto compounds, e.g. phenyl mercapto tetrazole, quaternary benzothiazole derivatives and benzotriazole.

The layers of photographic material may be hardened in the usual manner, for example with formaldehyde or halogen substituted aldehydes containing a carboxyl group, such as mucobromic acid, diketones, methane sulphonic acid esters and dialdehydes. The photographic layers may also be hardened with epoxide, heterocyclic ethylene imine or acryloyl hardeners. The layers may also be hardened by the process according to German Offenlegungsschrift No. 2,218,009 to produce colour photographic materials suitable for high temperature processing. The photographic layers or multi-layered colour photographic materials may also be hardened with diazine, triazine or 1,2-dihydroquinoline hardeners. Examples of such hardeners include diazine derivatives containing alkyl sulphonyl or aryl sulphonyl groups, derivatives of hydrogenated diazines or triazines such as 1,3,5-hexahydrotriazine, fluoro substituted diazine derivatives such as fluoro pyrimidine, and esters of 2-substituted 1,2-dihydroquinoline or 1,2-dihydroisoquinoline-N-carboxylic acids. Vinyl sulphonic acid hardeners, carbodiimide hardeners and carbamoyl hardeners such as those described, for example, in German Offenlegungsschriften Nos. 2,263,602; 2,225,230 and 1,808,685, French Pat. No. 1,491,807, German Pat. No. 872,153 and DDR Patent No. 7218 are also suitable. Other suitable hardeners have been described, for example, in British Pat. No. 1,268,550.

EXAMPLE 1

1. Preparation of the emulsions

1. Magenta emulsions 5 g of sulphosuccinic acid-bis-(2-ethyl-hexyl)-ester followed by 50 g of magenta coupler corresponding to the following formula:

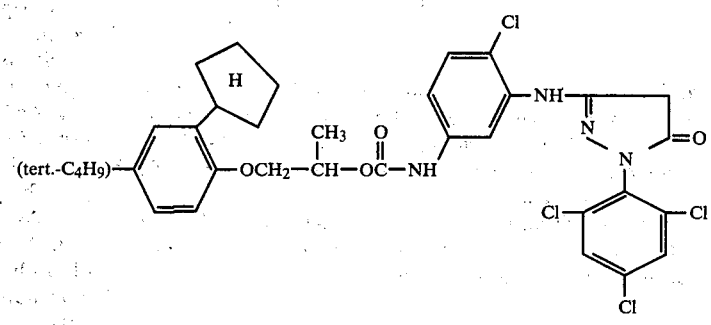

are dissolved in 100 g of diethyl carbonate at 40° C. The various compounds, 1.1, 1.9, 1.10, 1.21, 1.27, 2.3, 3.1 which are to be used according to the invention are then added, in each case in a quantity of 50 g dissolved in diethyl carbonate. 100 g of a 50% solution (in diethyl carbonate) of the compound corresponding to the formula:

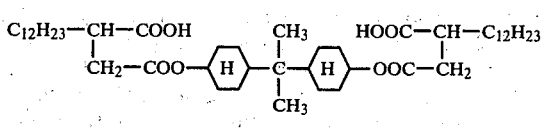

and 85 g of a 30% methanolic solution of the compound of the formula:

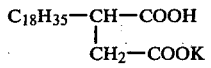

are added as oil formers.

This mixture is then emulsified in 1000 ml of a 10% gelatine solution at 50° C., using a high speed stirrer. The solvent is removed in a thin layer evaporator and the emulsion is stored at 4° C.

2. Yellow emulsions 5 g of sulphosuccinic acid-bis-(2-ethyl-hexyl)-ester followed by 50 g of yellow coupler corresponding to the following formula are dissolved in 200 g of diethyl carbonate at 40° C.

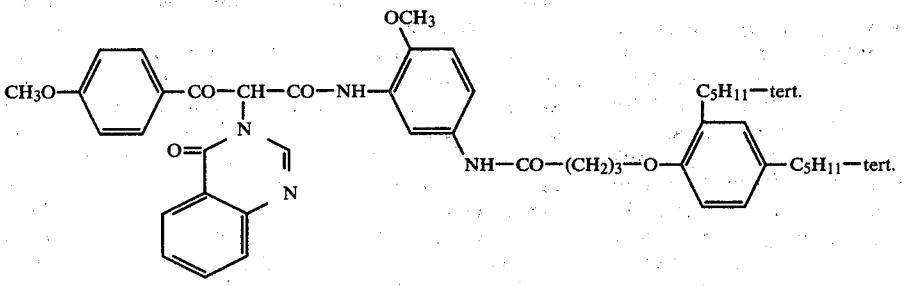

50 g of each of the emulsifiable compounds to be used according to the invention, 1.1, 1.9, 1.10, 1.21, 1.27, 2.3 and 3.1, in each case dissolved in diethylcarbonate, are then added. 50 g of a 50% solution (in diethyl carbonate) of the compound

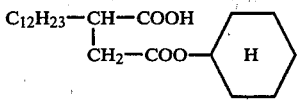

and 25 g of dibutyl phthalate are added as oil formers. This mixture is emulsified in 1000 ml of a 10% gelatine solution at 50° C. The solvent is removed in a thin layer evaporator and the emulsion obtained is stored at 4° C.

3. Cyan emulsions 5 g of sulphosuccinic acid-bis-(2-ethyl-hexyl)-ester followed by 35 g of cyan coupler corresponding to the following constitutional formula:

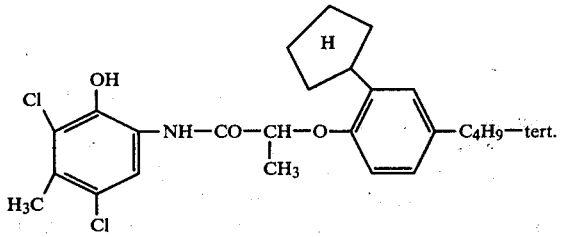

are dissolved in 175 g of diethyl carbonate at 40° C. The various emulsifiable compounds, 1.1, 1.9, 1.10, 1.21, 1.27, 2.3 and 3.1 to be used according to the invention are then added in each case in a quantity of 35 g dissolved in diethyl carbonate. 70 g of a 50% solution (in diethyl carbonate) of the compound corresponding to the formula

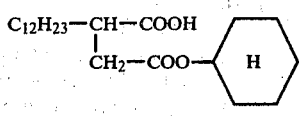

and 60 g of a 30% methanolic solution of the compound corresponding to the formula

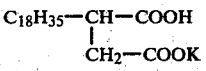

are added as oil formers. This mixture is emulsified in 1000 ml of a 10% gelatine solution at 50° C. The solvent is removed in a thin layer evaporator and the emulsion is stored at 4° C.

Preparation of a colour photographic material to be viewed by reflected light.

A colour photographic reflection viewing material is prepared by applying the following layers in succession to a paper substrate which has been laminated with polyethylene and treated with a bonding layer. The emulsion layers contain the usual additions of wetting agents, stabilizers etc.

1. As lowermost layer, a 4μ thick blue sensitive silver bromide layer containing, per kg of emulsion, 25.4 g of silver (88% AgBr, 12% AgCl), 80 g of gelatine and 860 g of the yellow emulsion described in I.2;

2. As intermediate layer, a 1μ thick gelatine layer;

3. As middle layer, a 4μ thick green sensitive silver chlorobromide emulsion layer containing, per kg of emulsion, 22 g of silver (77% AgCl, 23% AgBr), 80 g of gelatine and 650 g of the magenta emulsion described in I.1;

4. A 4μ thick UV-protective layer containing, per $m^2$, 0.7 g of UV absorbent corresponding to the formula;

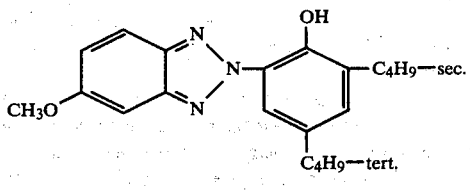

5. As upper layer, a 4μ thick red sensitive silver chlorobromide emulsion layer containing, per kg of emulsion, 23 g of silver (80% AgCl, 20% AgBr), 80 g of gelatine and 640 g of the cyan emulsion described in I.3;

6. A 1μ thick layer of gelatine.

111 Comparison of the dye stability

To test the effectiveness of the compounds to be used according to the invention, the colour photographic material to be viewed by reflected light described under 11 was compared with a material which had the same composition except that it did not contain any of the compounds to be used according to the invention. To carry out the comparison, each sample which has been exposed behind a separation wedge and then colour developed, bleached, fixed and washed in the usual manner was examined to find a point of density 0.7, and this spot was marked out. The material was then exposed to $7.5\times10^6$ lux hours of daylight in a south facing exposure station at 60% relative humidity. The reduction in colour was then measured on the same spot. The results are shown in Table 4.

TABLE 4

| Addition of Compound No. | Percentage loss of colour density in colour separations | | |
|---|---|---|---|
| | Yellow dye | Magenta dye | Cyan dye |
| None | 58% | 75% | 32% |
| 1.1 | 30% | 27% | 15% |
| 1.9 | 35% | 30% | 17% |
| 1.10 | 32% | 25% | 18% |
| 1.21 | 29% | 32% | 15% |
| 1.27 | 27% | 28% | 14% |
| 2.3 | 31% | 25% | 16% |
| 3.1 | 35% | 29% | 19% |

We claim:

1. Light sensitive photographic material comprising a support layer and at least one hydrophilic layer of binder containing a colour coupler for producing a dye image, wherein the material contains in an emulsified form at least one of the following compounds, I, II or III, which are insoluble in alkali solutions,

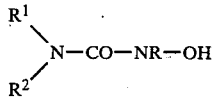

I

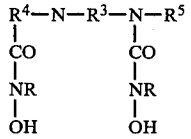

II

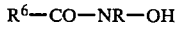

III in which

R represents hydrogen or an alkyl group;

$R^1$ represents hydrogen or an alkyl, cycloalkyl, aralkyl or aryl group;

$R^2$ represents an alkyl, cycloalkyl, aralkyl or aryl group;

$R^3$ represents a divalent hydrocarbon group;

$R^4$, $R^5$ which may be the same or different represent hydrogen or an alkyl group;

$R^6$ represents an alkyl with 7 to 11 carbon atoms, cycloalkyl, aralkyl or aryl group; and/or $R^1$ and $R^2$ may together represent the atoms required to complete a heterocyclic ring and/or $R^3$ together with $R^4$ and optionally $R^5$ may represent the atoms required to complete a heterocyclic ring, under the condition that when $R^1$ and $R^2$ together form a heterocyclic ring, this has at least 7 carbon atoms and that otherwise $R^1$ and $R^2$ together have at least 10 carbon atoms.

2. Color photographic image comprising a support layer and at least one hydrophilic layer of binder containing a dye image, wherein the image contains in an emulsified form at least one of the compounds I, II or III, which are insoluble in alkali solutions

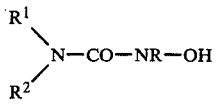

I

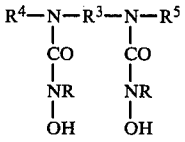

II

III in which

R represents hydrogen or an alkyl group;

$R^1$ represents hydrogen or an alkyl, cycloalkyl, aralkyl or aryl group;

$R^2$ represents an alkyl, cycloalkyl, aralkyl or aryl group;

$R^3$ represents a divalent hydrocarbon group;

$R^4$, $R^5$ which may be the same or different represent hydrogen or an alkyl group;

$R^6$ represents an alkyl with 7 to 11 carbon atoms, cycloalkyl, aralkyl or aryl group; and/or $R^1$ and $R^2$ may together represent the atoms required to complete a heterocyclic ring and/or $R^3$ together with $R^4$ and optionally $R^5$ may represent the atoms required to complete a heterocyclic ring, under the condition that when $R^1$ and $R^2$ together form a heterocyclic ring, this has at least 7 carbon atoms and that otherwise $R^1$ and $R^2$ together have at least 10 carbon atoms.

3. Material according to claim 1, characterized in that at least one of the compounds I to III is contained in it in a quantity of from 100 to 2000 mg/m$^2$.

4. Photographic image according to claim 2, at least one of the compounds I to III is contained in a quantity of from 100 to 2000 mg/m$^2$.

* * * * *